US009879481B2

(12) United States Patent
Fitzgerald

(10) Patent No.: US 9,879,481 B2
(45) Date of Patent: Jan. 30, 2018

(54) ADJUSTABLE BASE EXTENDER FOR A LADDER

(76) Inventor: Michael Patrick Fitzgerald, Galway (IE)

( * ) Notice: Subject to any disclaimer, the term of this patent is extended or adjusted under 35 U.S.C. 154(b) by 1381 days.

(21) Appl. No.: 13/138,921

(22) PCT Filed: Apr. 23, 2010

(86) PCT No.: PCT/IE2010/000026
§ 371 (c)(1),
(2), (4) Date: Oct. 25, 2011

(87) PCT Pub. No.: WO2010/122541
PCT Pub. Date: Oct. 28, 2010

(65) Prior Publication Data
US 2012/0037454 A1 Feb. 16, 2012

(30) Foreign Application Priority Data
Apr. 24, 2009 (IE) ..... S2009/0324

(51) Int. Cl.
*E06C 1/00* (2006.01)
*E06C 7/44* (2006.01)
*E06C 7/42* (2006.01)

(52) U.S. Cl.
CPC . *E06C 7/44* (2013.01); *E06C 7/42* (2013.01)

(58) Field of Classification Search
CPC ..... E06C 7/42; E06C 7/44; E06C 7/423
See application file for complete search history.

(56) References Cited

U.S. PATENT DOCUMENTS

| | | | | | |
|---|---|---|---|---|---|
| 3,933,221 | A * | 1/1976 | Sorenson | E06C 7/42 | 182/172 |
| 4,011,926 | A * | 3/1977 | Larson | E06C 7/42 | 182/107 |
| 4,082,162 | A * | 4/1978 | Diez | E06C 1/32 | 182/166 |
| 4,815,564 | A * | 3/1989 | Yoo | E06C 1/32 | 182/160 |
| 5,590,739 | A * | 1/1997 | High | E06C 1/12 | 182/169 |
| 6,073,726 | A * | 6/2000 | McCrystal | E06C 1/12 | 182/195 |
| 2004/0129497 | A1* | 7/2004 | Weiss | E06C 1/32 | 182/163 |
| 2009/0107765 | A1* | 4/2009 | Germond | E06C 7/423 | 182/172 |
| 2009/0299689 | A1* | 12/2009 | Stubben | G01C 9/08 | 702/154 |
| 2011/0067954 | A1* | 3/2011 | Deal | E06C 7/48 | 182/107 |

* cited by examiner

*Primary Examiner* — Jerry Redman

(57) ABSTRACT

A base extending mechanism is provided for a ladder in the form of pivotable lower leg sections which can be independently rotated outwards to provide a wider ladder base. This extension of the ladder base is complementary to and supported by a compatible ladder levelling mechanism.

6 Claims, 4 Drawing Sheets

ADJUSTABLE BASE EXTENDER FOR A LADDER

CROSS REFERENCE TO RELATED APPLICATIONS (Not Applicable)

STATEMENT REGARDING FEDERALLY SPONSORED RESEARCH OR DEVELOPMENT (Not Applicable)

THE NAMES OF PARTIES TO A JOINT RESEARCH AGREEMENT (Not Applicable)

INCORPORATION BY REFERENCE OF MATERIAL SUBMITTED ON A COMPACT DISK OR AS A TEXT FILE VIA THE OFFICE ELECTRONIC FILING SYSTEM (EFS-WEB)

(Not Applicable)

STATEMENT REGARDING PRIOR DISCLOSURES BY THE INVENTOR OR A JOINT INVENTOR (Not Applicable)

BACKGROUND OF THE INVENTION

(1) Field of the Invention

In general ladders, and in particular, lean-to ladders are ideal for use on horizontal ground. However, problems arise in using such ladders on uneven ground, and more particularly, on sloping or stepped ground. In such cases it is impossible to stand a lean-to ladder on sloping, stepped or uneven ground with the two ground engaging feet engaging the ground unless the ladder is allowed to tilt to one side or the other. This is particularly undesirable, since it can lead to serious instability of the ladder, with the possibility of the ladder toppling. There is therefore a need for a ladder which addresses the problem of standing a ladder on sloping, stepped or uneven ground.

(2) Description of Related Art Including Information Disclosed Under 37 CFR 1.97 and 1.98

(Not Applicable)

BRIEF SUMMARY OF THE INVENTION

The invention provides a ladder preferably for which a securing means is provided for securing the lower leg portion of at least one of the first and second legs which is pivotal intermediate its ends in a selected one of a plurality of selectable angled states, with the lower leg portion diverging at different angles from the other one of the first and second legs. This provides a wider ground base for the ladder, thereby increasing the stability of the ladder.

A further advantage of the invention is achieved when the lengths of both legs of the ladder are adjustable.

BRIEF DESCRIPTION OF THE SEVERAL VIEWS OF THE DRAWING(S)

The invention will be more clearly understood from the following description of some preferred embodiments thereof which are given by way of example only with reference to the accompanying drawings in which.

DETAILED DESCRIPTION OF THE INVENTION

Figure 1:
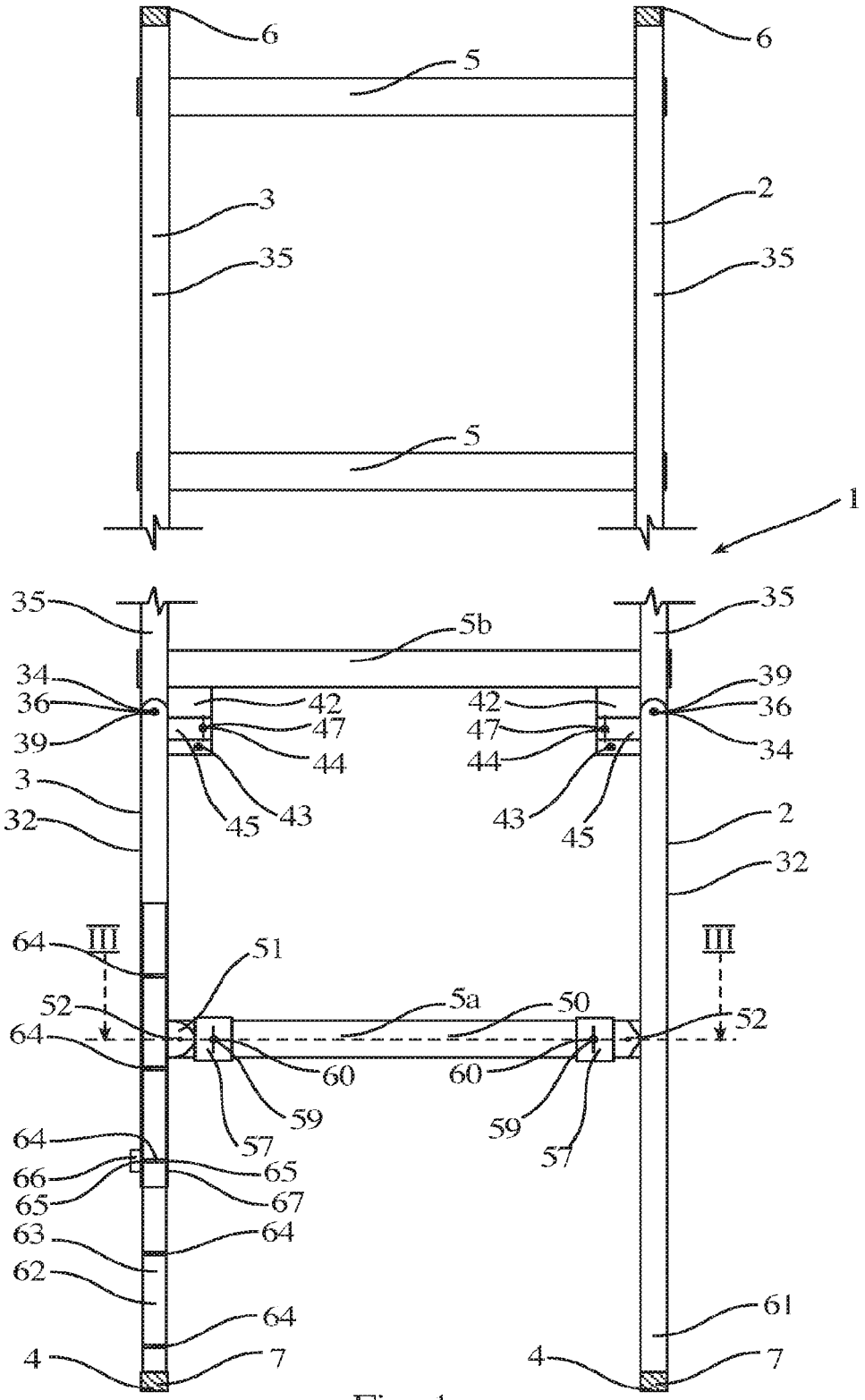
FIG. 1 is a front elevation of the ladder in a datum state of no splay and no levelling.
Figure 4:
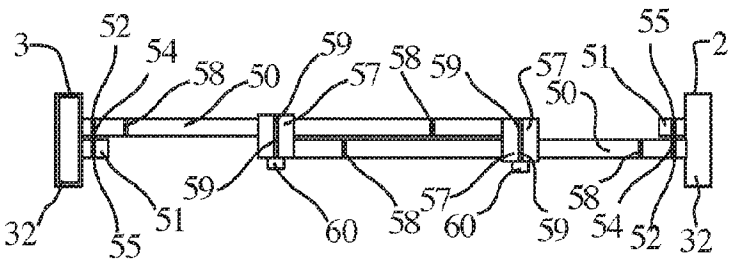
FIG. 4 is a cross-sectional plan of the ladder on the line IV-IV of FIG. 2
Figure 3:
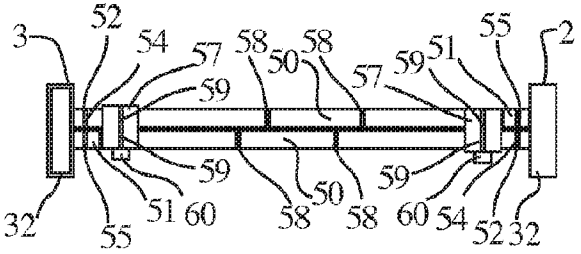
FIG. 3 is a cross-sectional plan of the ladder on the line III-Ill of FIG. 1

Referring to FIGS. 1 to 8 there is illustrated a ladder according to the invention indicated generally by the reference numeral 1. The ladder 1 in this embodiment of the invention is a lean-to ladder, and may be an extension lean-to ladder having one or more extension sections (not shown). The ladder 1 comprises a pair of elongated spaced apart first and second legs 2 and 3, respectively, extending between respective lower ends 4 and upper ends 6. A plurality of transversely extending rungs 5, only some of which are illustrated extend between and join the first and second legs 2 and 3 together. The rungs 5 are equi-spaced apart longitudinally along the first and second legs 2 and 3. The first and second legs and 3 terminate in ground engaging feet 7 for engaging the ground.

Figure 2:
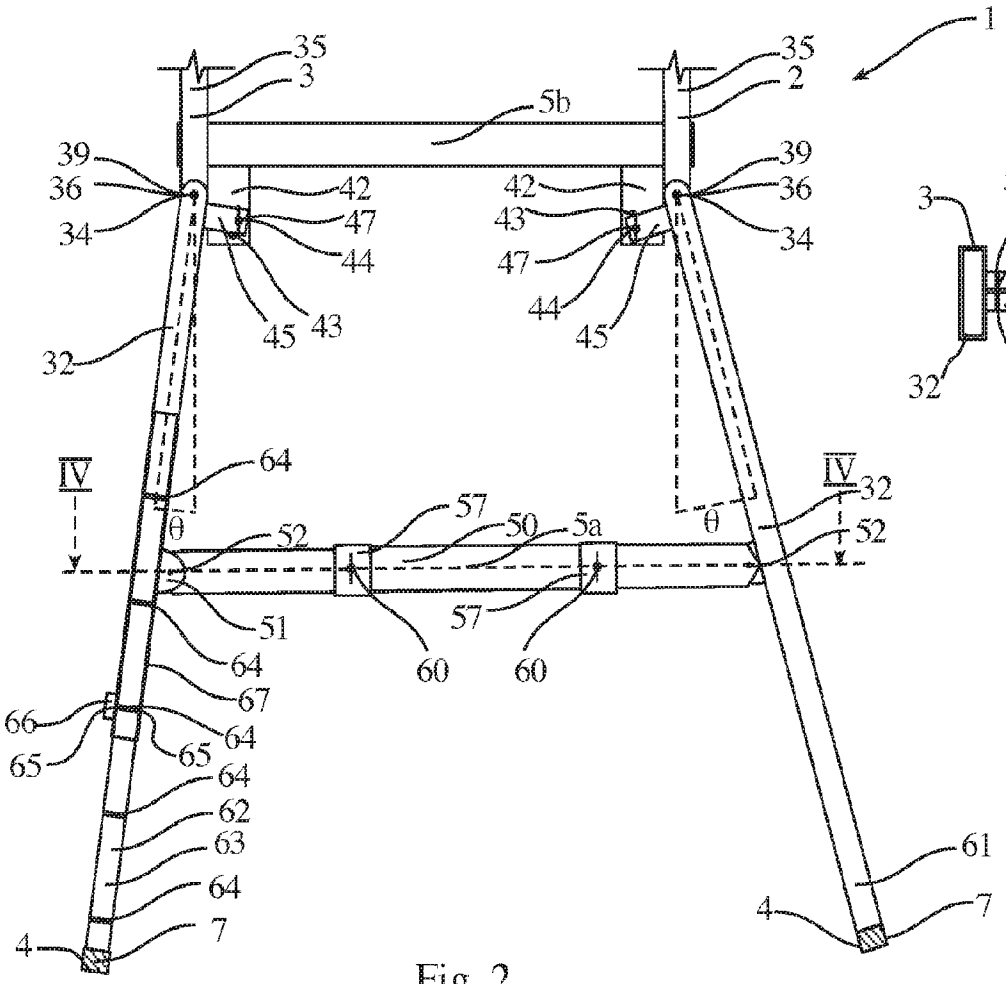
FIG. 2 is a front elevational view of the ladder in a splayed state with no levelling.
Figure 6:
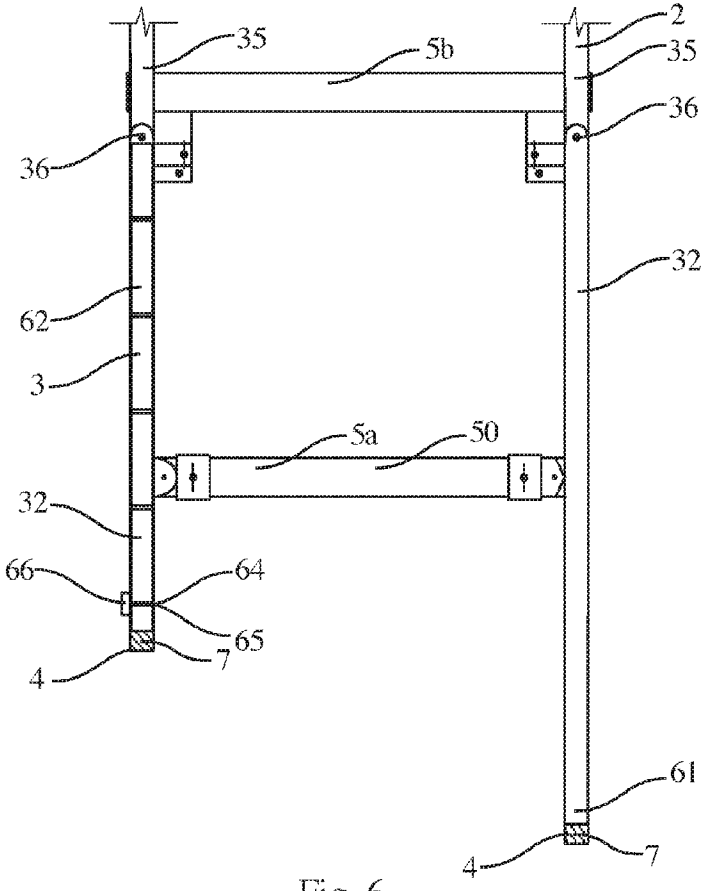
FIG. 6 is a front elevational view of the ladder in a leveled state for ground rising from right to left with no splay.
Figure 5:
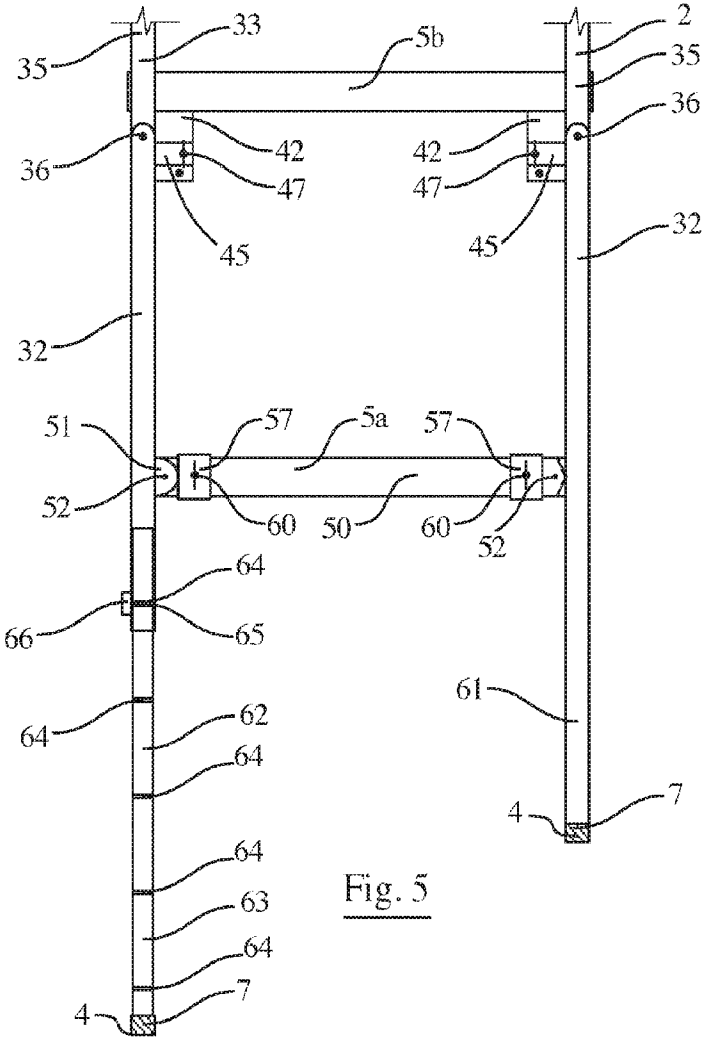
FIG. 5 is a front elevational view of the ladder in a leveled state for ground rising from left to right with no splay.
Figure 8:
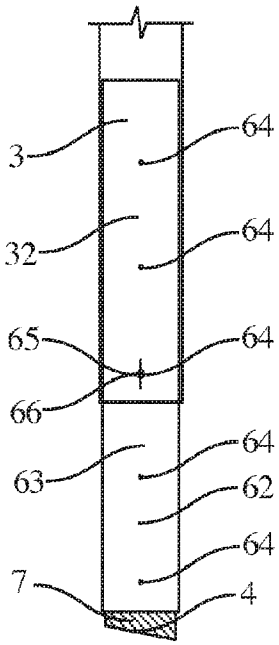
FIG. 8 is a side elevational/sectional view of the lower portion 32 of leg 3 of the sample setting in FIG. 7.
Figure 7:
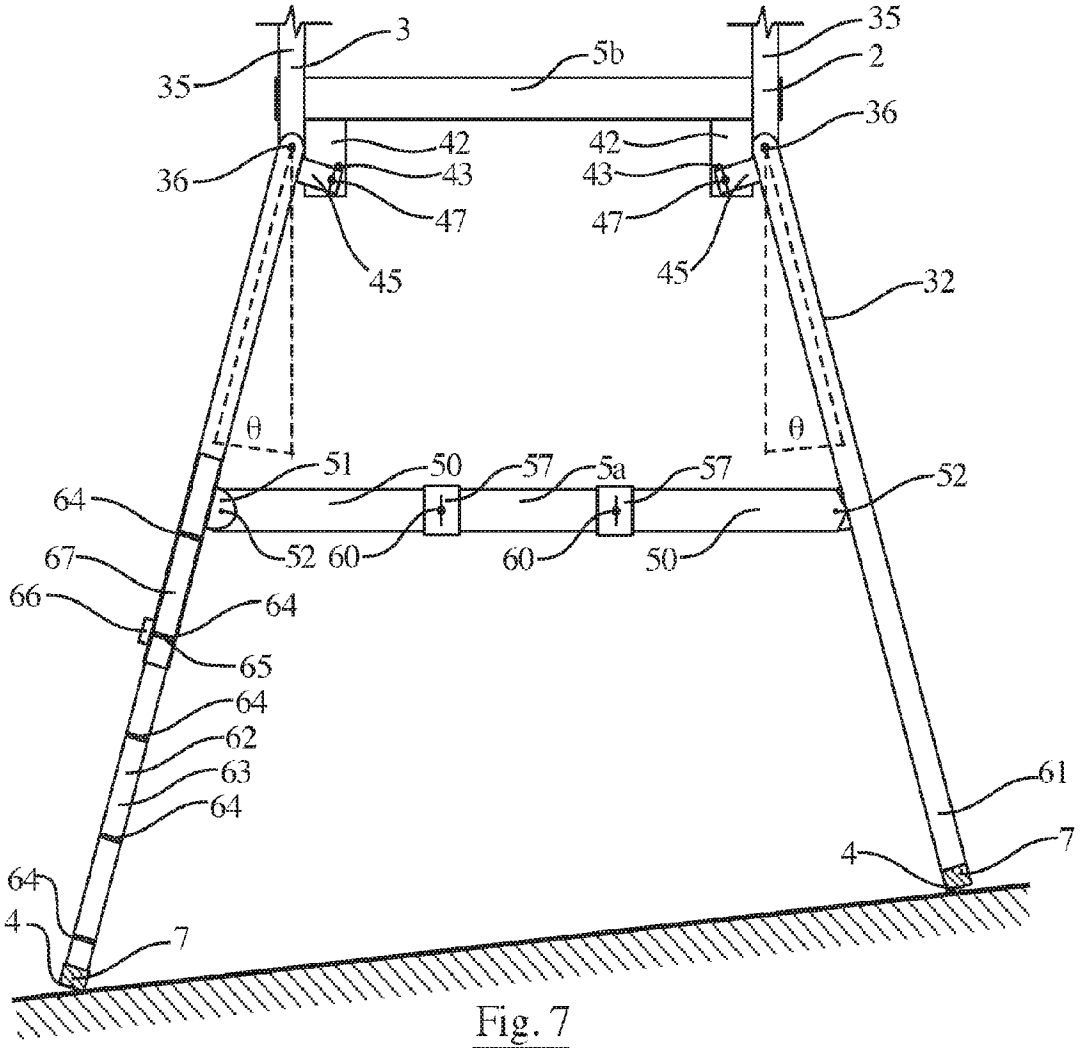
FIG. 7 is a front elevational view of the ladder in a sample splayed and leveled state for ground rising from left to right.

The first and second legs 2 and 3 of the ladder 1 are pivotal outwardly from an aligned state illustrated in FIGS. 1, 5 and 6 to selectable ones of a plurality of angled states, some of which are illustrated in FIGS. 2 and 7 for increasing the base width and in turn the stability of the ladder 1. Additionally, in this embodiment of the invention, the length of the second leg 3 is adjustable as will be described below.

Turning initially to the pivotal aspect of the lower leg portions 32, in this embodiment of the invention the first and second legs 2 and 3 are pivotal intermediate their lower and upper ends 4 and 6 about respective pivot axes 34 which extend perpendicularly relative to a plane defined by the first and second legs 2 and 3, so that each first and second leg 2 and 3 comprises an upper leg portion 35 and the lower leg portion 32 which is pivotal relative to the upper leg portion 35 about the corresponding pivot axis 34. In this embodiment of the invention the first and second legs 2 and 3 are pivotal intermediate the lowermost rung 5*a* and the next adjacent rung 5*b* so that only one rung extends between the lower leg portions 32 of the first and second legs 2 and 3, namely, the lowermost rung 5*a*. The lowermost rung 5*a* is of adjustable length, as will be described below, in order to accommodate pivoting of the lower leg portions 32 of the first and second legs 2 and 3 from the aligned state with the respective lower leg portions 32 aligned with the corresponding upper leg portions 35 and any one of the plurality of angled states with the lower leg portions 32 angled relative to the corresponding upper leg portion 35 and diverging from the lower leg portion 32 of the other one of the first and second legs 2 and 3.

Each lower leg portion 32 is pivotally coupled to the corresponding upper leg portion 35 by a corresponding pivot pin 36 which extends through a bore 39 extending through the lower leg portion 32 and a bore (not shown) extending through the upper leg portion 35. A plate 42 extends inwardly from the upper leg portion 35 of each first and second leg 2 and is secured to the corresponding upper leg portion 35 and the adjacent rung 5*b* by welding. A plurality of bores 43 extend through each plate 42 and are selectively alignable with a corresponding bore 44 in a securing 15 bracket 45 which extends from the adjacent lower leg portion 32 and is welded thereto. A securing means, namely, a securing screw 47 is engageable with the bore 44 and a selected one of the bores 43 for securing the adjacent lower leg portion 32 in the aligned state or in a selected one of the angled states relative to the corresponding upper leg portion 35. A nut (not shown) is provided for the securing screw 47 for securing the securing bracket 45 to the corresponding plate 42 with the corresponding lower leg portion 32 in the desired one of the aligned and angled states relative to the corresponding upper leg portion 35.

In this embodiment of the invention the bores 43 through the corresponding plates 42 are disposed so that the lower leg portion 32 of each first and second leg 2 and 3 can be set at an angle θ relative to the corresponding upper leg portion 35 of values of 0° (aligned with the upper leg portion 35), 8°, 12° and 16° diverging from the lower leg portion 32 of the other one of the first and second legs 2 and 3. It is, however, envisaged that in order to provide a greater number of angled states at which the lower leg portions 32 of the first and second legs 2 and 3 can be set relative to the upper leg portions 35, a plurality of bores 44 would be provided in the securing bracket 45 as well as a plurality of the bores 43 in the plate 42, and the bores 43 and 44 would be arranged in the plate 42 and the securing bracket 45, respectively, to provided vernier type adjustment.

The lowermost rung 5*a* comprises a pair of rung members 50, each being pivotally secured to a corresponding one of the lower leg portions 32 by a mounting bracket 51. Pivot pins 52 through bores 54 and 55 in the rung members 50 and mounting brackets 51, respectively, pivotally couple the rung members 50 to the mounting brackets 51. Each rung member 50 terminates in an eye member 57 for slideably engaging the corresponding rung member 50. Threaded bores 58 in each rung member 50 are alignable with corresponding bores 59 in the eye members 57 for selectively setting the length of the rung members 50 to correspond with the angular setting of the lower leg portions 32. Screws 60 through the bores 59 in the eye members 57 are engageable with the corresponding aligned threaded bore 58 in the rung members 50 for securing the rung members 50 together so that the lowermost rung 5*a* is of the desired length.

The ground engaging element 61 of lower leg portion 32 of leg 2 is of fixed height. As mentioned above, the length of the second leg 3 of the ladder 1 is adjustable. In this embodiment of the invention a second ground engaging element 62 which comprises an elongated member 63 which is telescopingly slideable within the lower leg portion 32 of the second leg 3. For urging the second ground engaging element 61 inwardly and outwardly of the lower leg portion 32 of the second leg 3, a plurality of retaining bores 64 extend transversely through the second ground engaging element 62, and are selectively alignable with an alignable bore 65 which extends transversely through the lower leg portion 32 of the second leg 3. A retaining means, namely, a retaining screw 66 is engageable with the alignable bore 65 in the second leg 3 and a selected one of the retaining bores 64 in the second ground engaging element 62 for securing the second ground engaging element 62 in a desired state relative to the second leg 3. Screw threads are provided in the alignable bore 65 for engaging the retaining screw 66, for securing the second ground engaging element 62 in a desired state relative to the lower leg portion 32 of the second leg 3 so that the portion 67 of the second leg 3 below the lowermost rung 5*a* is of the desired length.

In use, one or both of the lower leg portions 32 are initially pivoted about the corresponding pivot pin 36 in order to set the lower leg portion 32 in the desired angled states relative to the corresponding upper leg portions 35 in order to provide the ladder 1 with the desired degree of stability. The lower leg portions 32 may be set at similar or different angled states. Once the lower leg portions 32 have been set at the desired angled states, or indeed in the aligned state, the securing brackets 45 are secured to the corresponding plates 42 by the securing screws 47 and nuts 48. The rung members 50 of the lowermost rung 5*a* are then secured to each other by the screws 60 through the bores 58 in the rung members 50 and the threaded bores 59 in the eye members 57.

Thereafter the second ground engaging element 62 is adjusted relative to the corresponding lower portion 32 of the second leg 3 until the length of the second leg 3 is adjusted to the desired length. The second ground engaging element 62 is then secured in position by the screw 66 through the alignable bore 65 and the selected one of the retaining bores 64. Thereafter, the ladder is ready for use.

While the ladders have been described as being lean-to ladders, it is envisaged that the ladders may be provided in the form of an A-frame ladder, in which case both elements of the A-frame ladder would be provided with at least one adjustable leg. Additionally, it is envisaged that both elements of the A-frame ladder would be provided with at least one leg pivotally connected intermediate its legs to define an upper leg portion and a lower leg portion similar to the upper and lower leg portions 35 and 32 of the ladder 1.

While the ladder 1 described with reference to FIGS. 1 to 8 has been described as comprising one leg of adjustable length, it is envisaged that the ladder 1 may be provided with both legs being of adjustable length.

While the ground engaging element has been described as telescoping into the adjustable leg, while this is desirable, it is not essential. In certain cases, the adjustable leg may telescope into the ground engaging element. Indeed, it is also envisaged that while it is desirable to have the ground engaging element telescoping relative to the adjustable leg, any other mounting arrangement which permits movement of the ground engaging element relative to the adjustable leg may be used.

It is also envisaged that the pivot axes about which the legs are pivotal intermediate their ends may be located between any pair of rungs or adjacent any rungs, for example, between the second and third rungs from the lower end of the ladder. In which case both the lowermost rung and the second rung would be of adjustable length, to accommodate outward pivoting of the lower leg portions 32. It is also envisaged that the first and second legs of the ladders may be pivotal towards the upper end thereof for facilitating splaying of the upper ends of the ladders. Such pivoting of the upper end portions of the ladder would be similar to the pivoting of the lower leg portions thereof.

While the ladders have been described as comprising one or both legs being of adjustable length, it is envisaged that the ladder 1 described with reference to FIGS. 1 to 8 may be provided without the legs being of adjustable length, in which case, the ladder 1 of FIGS. 1 to 8 may be provided with only one leg being pivotal intermediate its ends to be pivoted from an aligned state to one or more angled states, or the ladder 1 of FIGS. 1 to 8 may be provided with both legs pivotal intermediate their ends to be pivoted between respective aligned states and one or more angled states.

The invention claimed is:

1. A ladder (1) comprising elongated first (2) and second (3) legs, having ends, spaced apart from each other and extending between respective lower (4) and upper (6) ends, and being joined by a plurality of transversely extending rungs (5) spaced apart along the first and second legs, at least one of the first and second legs being pivotal intermediate the ends about a first pivot axis (34) extending perpendicularly to a plane defined by the first and second legs and defining an upper leg portion (35) and a lower leg portion (32), the lower leg portion being pivotal relative to the upper leg portion about the pivot axis between an aligned state with the upper and lower leg portions aligned with each other and an angled state with the lower leg portion extending from the upper leg portion in a direction diverging from each other one of the first and second legs characterized in that the pivot axis (34) is positioned above a lowermost of said plurality of transversely extending rungs and the lower leg portions (32) being only ground engaging legs, only supporting legs of a lowermost rung and only legs connected to a lowermost rung.

2. A ladder as claimed in claim 1 in which a securing means (47) is provided for securing the lower leg portion of at least one of the first and second legs which is pivotal intermediate the ends in a selected one of the aligned state and the angled state.

3. A ladder as claimed in claim 2 in which the securing means (47) is adapted for securing the lower leg portion of at least one of the first and second legs which is pivotal intermediate the ends in a selected one of a plurality of selectable angled states, with the lower leg portion diverging at respective different angles from the other one of the first and second legs.

4. A ladder as claimed in claim 1 in which at least one rung (5*a*) extends from the lower leg portion of the at least one of the first and second legs, which is pivotal intermediate the ends (51/52).

5. A ladder as claimed in claim 4 in which each rung 5 extending from the lower leg portion of the at least one of the first and second legs, which is pivotal intermediate the ends, is of adjustable length.

6. A ladder as claimed in claim 1 in which both of the first and second legs are pivotal intermediate their respective ends about respective corresponding pivot axes extending perpendicularly to the plane defined by the first and second legs.

* * * * *